United States Patent [19]

Erhard

[11] 4,280,418

[45] Jul. 28, 1981

[54] METHOD OF COMBINING IN-THE-MILL DRYING AND FIRING OF COAL WITH ENHANCED HEAT RECOVERY

[75] Inventor: Helmut Erhard, Mason City, Iowa

[73] Assignee: Heidelberger Zement Aktiengesellschaft, Fed. Rep. of Germany

[21] Appl. No.: 56,631

[22] Filed: Jul. 11, 1979

[51] Int. Cl.[3] ..... F23D 1/00

[52] U.S. Cl. ..... 110/347; 432/106; 432/78

[58] Field of Search ..... 432/78, 105, 106; 110/347, 104 B, 106

[56] References Cited

U.S. PATENT DOCUMENTS

| | | | |
|---|---|---|---|
| 1,608,699 | 11/1926 | Kreisinger et al. | 110/106 |
| 1,628,609 | 5/1927 | Newhouse | 110/106 |
| 2,259,967 | 10/1941 | Vogel-Jorgensen | 110/106 |
| 3,043,525 | 7/1962 | Gilbert | 110/106 |
| 3,273,520 | 9/1966 | Hottenstine | 110/106 |
| 3,276,755 | 10/1966 | Bast | 432/78 |
| 3,881,862 | 5/1975 | Nishida et al. | 432/106 |
| 4,169,701 | 10/1979 | Katayama et al. | 110/347 |
| 4,223,640 | 9/1980 | Rochford et al. | 110/347 |
| 4,226,585 | 10/1980 | Deussner | 432/106 |

*Primary Examiner*—Henry C. Yuen
*Attorney, Agent, or Firm*—Stass & Halsey

[57] ABSTRACT

A method for drying coal in a coal mill and pneumatically conveying it to a kiln for burning, with a portion of the coal-dust-laden air generated thereby being diverted to a clinker cooler adjacent the kiln in order to ignite the suspended particles and supply hot air for burning the coal. The diverted air is later recirculated back to the coal mill to help dry the coal.

12 Claims, 1 Drawing Figure

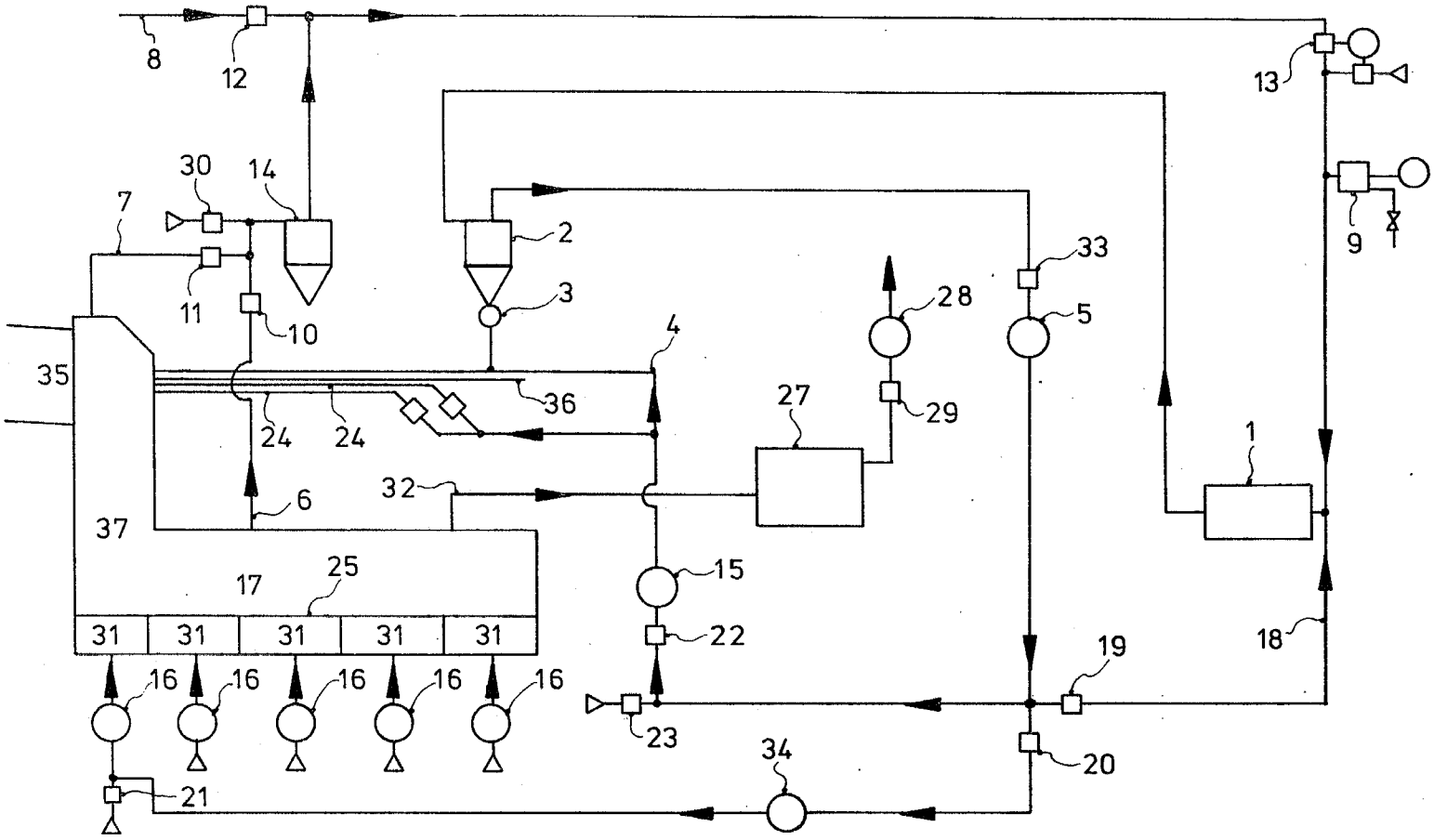
1
2
3
4
5
6
7
8
9
10
11
12
13
14
15
16
17
18
19
20
21
22
23
24
25
27
28
29
30
31
32
33
34
35
36
37

METHOD OF COMBINING IN-THE-MILL DRYING AND FIRING OF COAL WITH ENHANCED HEAT RECOVERY

BACKGROUND OF THE INVENTION

The invention relates to an ecologically beneficial and energy-saving way to dry and burn coal using a minimum amount of primary air, even in the case of high coal moisture.

Flame formation is a great influence in the energy consumption of process kilns. For low consumption of heat, energy rapid calcination with more enhanced heat transfer by a hot flame of brief duration is necessary. In addition to other factors, important influencing factors therefor are: the primary air constituent of the combustion air, the temperature of secondary and primary air, as well as aeration or insufflation impulse ratios. The primary air constituent should be minimized and the temperatures of the primary and secondary air should be maximized. The insufflation velocity and angular-momentum should be freely selectable in the optimum range.

Heretofore, the following coal firing or burning methods are known: (1) indirect firing, (2) direct firing, and (3) semidirect firing with and without an extra filter.

In indirect firing, the in-the-mill coal drying system is operated fully independently of the kiln firing. In this method, the principal influencing factors for the flame formation can be optimized independently of the in-the-mill drying system. However, a separate filter for purifying the outgoing dust-laden mill air and an intermediate storage bin for the brushed, dried coal are necessary. Hence, this method is exposed to the danger of coal-dust explosions and coal-dust fires. Also, the costs for the necessary investment, service, and maintenance are high.

In direct firing, all of the outgoing coal-dust-laden mill air is injected into the process kiln. This lowers investment costs considerably since, for example, a separate filter for purifying the outgoing dust-laden mill air and an intermediate storage bin for the crushed, dried coal can be dispensed with. Due to the absence of these intermediate units and the necessary intermediate processing steps, the danger of coal-dust explosions and coal fires is reduced considerably. However, the large proportion of primary air is a drawback. Accordingly, optimum insufflation impulse ratios in the kiln burner cannot be achieved.

In semidirect firing, the outgoing coal-dust-laden mill air is pre-cleaned in a cyclone. A portion of this air is returned as circulating air to the mill system and serves as complementary carrier air in the mill, while the remainder is injected into the furnace together with the centrifugally (cyclone) separated coal dust. In the case of high coal moisture and low-temperature heating of the mill, the drying will result in a greater amount of outgoing air than conforms to the required amount of carrier air. Thus, in these instances, either a large amount of primary air must be tolerated or an extra filter must be installed, resulting in drawbacks such as those encountered with direct and indirect firing. Therefore, a large amount of primary air hampers optimization of the insufflation impulse ratios in the kiln burner, and an extra filter results in additional investment costs and a greater danger of coal-dust explosions and coal fires.

SUMMARY OF THE INVENTION

Therefore, the general object of the invention is to provide a method wherein, independently of the coal moisture and the mill heating, the primary air constituent can be minimized at will and the insufflation ratios in the burner nozzle adjusted independently of the in-the-mill drying method without having to accept a separate coal-dust filter or an intermediate storage bin and the concomitant safety problems and additional costs as with an indirect system, and wherein the heat of the outgoing mill air can be recovered.

This object is achieved by proving in that the proportion of outgoing coal-dust-laden mill air which is not required as primary air is utilized to heat up the secondary air and/or cool the heated material.

In a preferred embodiment of the invention, that portion of the outgoing mill air not required as primary air is pre-cleaned by means of a precleaner, more particularly a cyclone, and employed to cool the heated material and/or to heat up the secondary air, so that also the heat from the material is recovered to heat up the outgoing mill air.

In another preferred embodiment, the hot outgoing coal-dust-laden mill air is injected into the hot front portion of the clinker air cooler so that in this case, too, the heat is recovered and, moreover, the residual coal dust is ignited in this hot zone so that it is largely removed as a result and can advantageously be utilized to heat up the secondary air.

In another preferred embodiment, the outgoing mill air, after being pre-cleaned, is injected below the grate of the clinker air cooler.

In another preferred embodiment, the outgoing mill air, after being pre-cleaned is injected above the grate of the clinker air cooler.

In a further embodiment of the method of the invention, hot air from the clinker air cooler or from the port end of the furnace is employed to dry the coal.

In another embodiment, hot outgoing flue gas of the furnace installation is utilized to dry the coal.

In contrast, in another preferred embodiment, a particular fuel is employed to dry the coal.

The method of the invention is particularly suited for the calcination of cement clinkers, calcium or expanded clay with a rotary kiln having a subsequent planetary, barrel, vertical or fluidized-bed cooler.

Furthermore, a vertical or reciprocating-plate kiln is utilized for the calcination of cement clinkers, calcium or expanded clay.

The method of the invention is likewise suitable for in-the-mill drying with a bowl mill or ball mill.

Finally, the method of the invention is also suitable for use with a pure coal fuel or a mixed fuel of coal and other fuels.

While the invention has been described and illustrated in its several preferred embodiments, it should be understood that the invention is not to be limited to the precise details herein illustrated and described, since the same may be carried out in other ways falling within the scope of the invention as claimed.

Thus, it becomes possible to reduce the proportion of the amount of primary air for the kiln burner to the minimum necessary for optimum combustion independently of the in-the-mill drying system and of the coal moisture and, at the same time to, utilize without a separate filter unit the remaining amount of outgoing mill air without polluting the environment and with savings in energy. The method of the invention saves energy because the heat from the hot outgoing mill air is re-used to heat up the secondary air. Furthermore, the residual coal dust of the outgoing mill air is fed to the secondary air, so that it does not have to be filtered out. Specifically, according to a special embodiment of the method of the invention, this residual coal dust can be burned in the secondary air current. This means a more direct and full utilization of all of the coal dust in the outgoing mill air, so that the method of the invention results not only in a saving of energy or raw materials, but also operates without polluting the environment, since the residual coal dust is removed, thereby obviating the need for a separate filter unit.

In addition, since no intermediate coal storage bin or filter unit is required and because of the possibility of operating the associated in-the-mill drying system at low hot-air temperatures without heat losses, even if there is a high percentage of moisture in the coal, the method of the invention affords a high degree of protection against the danger of coal-dust explosions and coal fires, and even high coal moistures can be overcome without difficulty by the extensive use of the waste heat of the furnace and/or the clinker air cooler.

BRIEF DESCRIPTION OF THE DRAWING

The method of the invention will be described with reference to the accompanying FIGURE, wherein a device operating along the principles of the invention is illustrated schematically. The device shown herein includes in particular a cement kiln having a clinker thrust grating air cooler.

DESCRIPTION OF THE DETAILED EMBODIMENT

The coal crushed and dried in coal mill or crusher 1 is separated in high-efficiency cyclone 2 and charged by means of shut-off device 3 into the primary air current of primary air conduit 4 before being used to heat rotary kiln 35.

The amount of gas or air required as carrier air drawn by system blower 5 through coal mill 1 and high-efficiency cyclone 2, the flow being regulated by system damper 33. As coal drying air delivered to mill 1, either hot air-cooler air through air-cooler air conduit 6, hot port-end air through port-end air conduit 7, furnace flue gas through furnace flue gas conduit 8, hot gas from combustion chamber or booster heater 9, or a combination of air-cooler air, port-end air, furnace flue gas, and hot gas may be used, with air-cooler air damper 10, furnace air damper 11, furnace flue gas damper 12, combustion-chamber damper 13, and cold-air or atmospheric-airdamper 30 being employed for regulation purposes. Hot air through conduits 6 and 7 is pre-cleaned in cyclone 14. The outgoing coal-dust-laden mill air, which is pre-cleaned in high-efficiency cyclone 2, is split up behind system blower 5 and can be moved both to primary-air blower 15, to the mill inlet via connecting-conduit damper 19 through connecting conduit 18, or to cooling-air blower 16 of clinker air cooler 17. The proportions of the various quantities can be optimized in accordance with the requirements of the mill system, the coal moisture, and the flame formation, and adjusted in the range between 0 and 100%. To this end, the following are employed: connecting-conduit damper 19, cooling-air-supply damper 20, and auxiliary damper 21, as well as primary-air damper 22 and cold-air admixing damper 23.

Due to these regulating facilities, the primary air constituent of the combustion air can be lowered at will and various combustion nozzles 24 and fuels such as make-up fuel 36 may be utilized, regardless of the coal moisture and the conditions prevailing in the in-the-mill drying system.

Thus, especially in the case of high coal moistures, a fairly large proportion of outgoing mill air is injected into the clinker air cooler. This insufflation is effected, for example, with an existing cool-air blower 16, as shown in the figure, or directly into one of the cooling chambers 31 (not shown). The injected air may also be split among a plurality of cool-air blowers 16 or even, with a separate cool-air-supply blower 34, delivered to one or more cooling-air chambers 31, or the injected air may be moved directly into the hot-air portion of clinker air cooler 37 via grate 25. Preferably, however, air is injected into the cooling-air chambers 31 closest to the hot-air portion of clinker air cooler 37. In this way, the thermal heat of the outgoing mill air can be fully utilized to heat up the secondary air. Moreover, the non-thermal component still entrapped in the outgoing mill air as a residual coal-dust component is ignited during the passage through the hot clinker layer and is thus utilized. It heats the secondary air further. The excess outgoing air of the air cooler is fed via outgoing-air conduit 32 to outgoing-air dust eliminator 27, where it is cleaned. By means of outgoing-air blower 28 and damper 29, the outgoing air is exhausted to the atmosphere in dependence upon the port-end pressure.

In the method according to the invention, all of the heat of the outgoing air, i.e., both the thermal heat and the heat entrapped in the residual coal dust of the outgoing air is recovered, in contrast to the indirect method. Moreover, due to the combustion of the residual coal dust component, there is no need for a coal filter. This results in considerable savings and in an increase in operational reliability. Also, little coal dust is exhausted to the atmosphere, so that ecologically speaking, the method of the invention is considerably more beneficial than the methods heretofore known. Too, no intermediate bunkering of coal dust is necessary so that the danger of coal-dust fires and coal-dust explosions is substantially reduced. On the whole, investment, service, and operating costs are lower.

Unlike the direct and semidirect methods, the amount of primary air can be freely selected, so that flame optimization is possible and the amount of primary air can be reduced considerably. This results in fuel economy which, in the case of high coal moistures, may amount to about 100 kcl/kg clinkers (0.42 GJ/t clinkers).

I claim:

1. A method for using solid fuel to heat a kiln which discharges heated materials to a cooler, comprising:

pulverizing the fuel in a mill;

pneumatically conveying the pulverized fuel to a separator for separating fuel particles from fuel-dust-laden air;

pneumatically conveying the separated fuel particles to the kiln for burning; and conveying at least a portion of the fuel-dust-laden air to the cooler.

2. The method of claim 1, wherein the step of pneumatically conveying the separated fuel particles to the kiln for burning is accomplished by using a portion of the fuel-dust-laden air as primary air to convey the separated fuel particles to the kiln.

3. The method of claim 2, further comprising the step of using the fuel-dust-laden air conveyed to the cooler as secondary air for burning the separated fuel particles.

4. The method of claim 3, wherein the step of pneumatically conveying at least a portion of the fuel-dust-laden air to the cooler includes the step of injecting said at least a portion of the fuel-dust-laden air beneath a support within the cooler for supporting the heated materials.

5. The method of claim 4, further comprising the step of conveying air from the cooler to the mill for drying the fuel.

6. The method of claim 4, further comprising the step of conveying the combustion gasses of the burned fuel particles to the mill for drying the fuel.

7. The method of claim 4, further comprising the step of burning make-up fuel in addition to pulverized solid fuel for heating the kiln.

8. The method of claim 4, 5, 6, or 7, further comprising the step of recirculating a portion of the fuel-dust-laden air back to the mill.

9. A method for using coal to heat a kiln which discharges heated clinkers to a grate in a clinker cooler, comprising:

pulverizing the coal in a coal mill;

pneumatically conveying the pulverized coal to a cyclone;

separating coal particles from coal-dust-laden air in the cyclone;

splitting the coal-dust-laden air leaving the cyclone into at least first and second streams;

using the first stream of coal-dust-laden air as primary air to blow the separated coal particles to the kiln for burning;

injecting the second stream of coal-dust-laden air into the clinker cooler beneath the grate thereof to burn the suspended coal dust;

using the heated air obtained from the previous step as secondary air for burning the separated coal particles; and conveying the combustion gasses from the burned coal particles to the coal mill to dry the coal therein.

10. The method of claim 9, further comprising the step of conveying heated air from the clinker cooler to the coal mill to dry the coal therein.

11. The method of claim 10, further comprising the step of cleaning the combustion gasses and air from the clinker cooler before conveying them to the coal mill.

12. The method of claim 11, wherein the step of splitting the coal-dust-laden air leaving the cyclone into at least first and second streams comprises splitting the coal-dust-laden air leaving the cyclone into first, second, and third streams, and further comprising the step of recirculating the third stream back to the coal mill.

* * * * *